United States Patent [19]

Knodt

[11] Patent Number: 4,746,953

[45] Date of Patent: May 24, 1988

[54] MEMBRANE STRIP CONTROL

[75] Inventor: Ruediger W. Knodt, Rochester, N.Y.

[73] Assignee: Xerox Corporation, Stamford, Conn.

[21] Appl. No.: 916,766

[22] Filed: Oct. 8, 1986

[51] Int. Cl.[4] ..... G03G 15/00

[52] U.S. Cl. ..... 355/7; 355/14 R; 200/5 A

[58] Field of Search ..... 355/7, 14 R; 200/5 A, 200/61.43; 340/365 R

[56] References Cited

U.S. PATENT DOCUMENTS

| | | | |
|---|---|---|---|
| 3,689,143 | 9/1972 | Case et al. | 355/3 |
| 4,012,122 | 3/1977 | McVeigh | 350/160 |
| 4,105,327 | 8/1978 | Gibson et al. | 355/59 |
| 4,215,929 | 8/1980 | Sato et al. | 355/7 |
| 4,277,163 | 7/1981 | Ikesue et al. | 355/14 R |
| 4,486,092 | 12/1984 | Ichinokawa | 355/49 X |
| 4,639,559 | 1/1987 | Taguchi | 200/5 A |
| 4,687,317 | 8/1987 | Appel et al. | 355/7 X |

FOREIGN PATENT DOCUMENTS

| | | | |
|---|---|---|---|
| 2928740 | 2/1981 | Fed. Rep. of Germany . | |
| 0015948 | 1/1984 | Japan | 355/7 |

*Primary Examiner*—Peter S. Wong
*Assistant Examiner*—Kristine Peckman
*Attorney, Agent, or Firm*—Ronald F. Chapuran

[57] ABSTRACT

A control system for entering data into a copier controller relating to the parameters of an original to be copied, having a platen upon which the original is placed for exposure, comprising electrically sensitive membrane strips applied adjacent to the platen, said strips being formed with touch sensitive portions whereupon touching by an operator effects a signal indicative of the location of the touch, and means connecting the strips to the controller for transmitting the signals thereto, the signals being representative of document size. Also included is a special switch to convert the touch sensitive portions of the membrane strips into document editing functions.

5 Claims, 6 Drawing Sheets

DCR
78
MIR
76
XER
74
PHR
72
CPM
70
88
80
RSE
FIN
WDT
M. CLK
PR
M. CLK
50
27
CONTROL PANEL
86
MMB
84
RDHR
82
OUTPUTS
MACHINE SENSORS SWITCHES
DIGITAL OUT
ANALOG OUT
ANALOG IN
PAPER DRIVES
MACHINE SENSORS & SWITCHES
DOCUMENT DRIVES
SWITCH INPUT 10
90a
REG. FINGERS
92
M.CLK SENSOR
66
90b
72
≈1.03ms
M.CLK
PHR
PITCH RESET INTR.
70
CPM

MEMBRANE STRIP CONTROL

BACKGROUND OF THE INVENTION

The present invention relates to the controls of a xerographic reproduction machine, and in particular to the use of electrically sensitive membrane strips to determine document size, edit the document, and determine other process parameters.

In the control of modern complex, sophisticated reproduction machines, simplicity and ease of operator control are of prime importance. Various techniques have been used to simplify the control process. For example, with respect to variable magnifications, the manual setting of the magnification ratio by the operator depending upon the operator determination of the size of the document and the size of the copy sheet, often resulted in the wrong magnification ratio. To offset the possibility of this type of operator error, it is known as disclosed in U.S. Pat. No. 4,277,163 to use calipers moved by the operator into alignment with the edge of the document and connected to a transducer to produce a signal proportional to the position of the caliber. This information is fed to a computing and control unit to calculate the document size. It is also known as disclosed in U.S. Pat. No. 3,689,143 to use a plurality of sensing devices to detect the size of a document as it is inserted and moved into the machine. This information is converted by the control logic to select a particular optical magnification. In addition, U.S. Pat. No. 4,105,327 discloses a set of indicators moved by the operator to frame the document and simultaneously set the optical system. These prior art devices, however, are often complex and costly.

Another difficulty with the prior art devices is that the control console is usually remote from the platen where document size registration markings are often provided. These tabs enable the operator to determine the size of a document, but do not necessarily assist in converting to the correct magnification ratio. Whenever document size indicators or markers are located at the platen, it is inconvenient for the operator to have to convert the determined size into a suitable magnification ratio. It is also inconvenient for the operator to then move to the operator control console to depress or engage the appropriate buttons or switches for the correct job parameter information. This inconvenience can often lead to operator error. It would be much more convenient and efficient for the operator when manually placing documents on the platen to have the appropriate controls located conveniently at the platen location. It would therefore, be desirable to provide an operative control panel that is accessible and convenient for the operator to provide document size and other information to the machine control. It would also be desirable to provide an operator control panel adjacent the platen for automatic input of document size and automatic determination of the correct magnification ratio.

Documents to be copied often contain material or subject matter that is of a classified nature of even irrelevant to the remaining material that needs to be copied. In such situations, it is necessary for the operator to block out, erase, or in some manner inhibit the copying of that particular information, or not copy the information at all. It is known in the prior art as disclosed in U.S. Pat. No. 4,215,929 to mask the projected light image of a document to recreate only a desired image on the photosensitive member. In addition, U.S. Pat. 4,012,12 discloses a liquid crystalline platen that becomes selectively opaque to mask portions of an original document exposed thereon. German Pat. DE No. 2928-740 discloses apparatus for reproducing selected areas of a text by using two scanning filters to determine color marked zones on an original. The information in the color marked zones is first stored and then read during a second scanning operation. A difficulty, however, with the prior art masking systems is that they are relatively complex, expensive and are not geared to ease of operator use and convenience. It would be desirable, therefore, to provide a relatively simple, accessible, low cost means for an operator to selectively edit or delete portions of a document to be copied.

It is an object of the present invention, therefore, to provide a new and improved operator control. It is another object of the present invention to provide a plurality of electrically sensitive membrane strips disposed near the platen to provide a simple means to automatically enter document size, magnification ratio, and other process control information to the machine control as well as to be able to selectively edit, add, subtract, or otherwise modify the image area on a document at the platen or at a composing station. Further advantages of the present invention will become apparent as the following description proceeds and the features characterizing the invention will be pointed out with particularity in the claims on next to and forming a part of this specification.

Briefly, the present invention is a control system for entering data into a copier controller relating to the parameters of an original to be copied, having a platen upon which the original is placed for exposure, comprising electrically sensitive membrane strips applied adjacent to the platen, said strips being formed with touch sensitive portions whereupon touching by an operator effects a signal indicative of the location of the touch, and means connecting the strips to the controller for transmitting the signals thereto, the signals being representative of document parameters such as document size. Also, included is a special switch to convert the touch sensitive document size portions of the membrance strips into document editing functions.

BRIEF DESCRIPTION OF DRAWINGS

For a better understanding of the present invention, reference may be had to the accompanying drawings wherein the same reference numerals have been applied to like parts and wherein.

DESCRIPTION OF THE INVENTION

Figure 1:
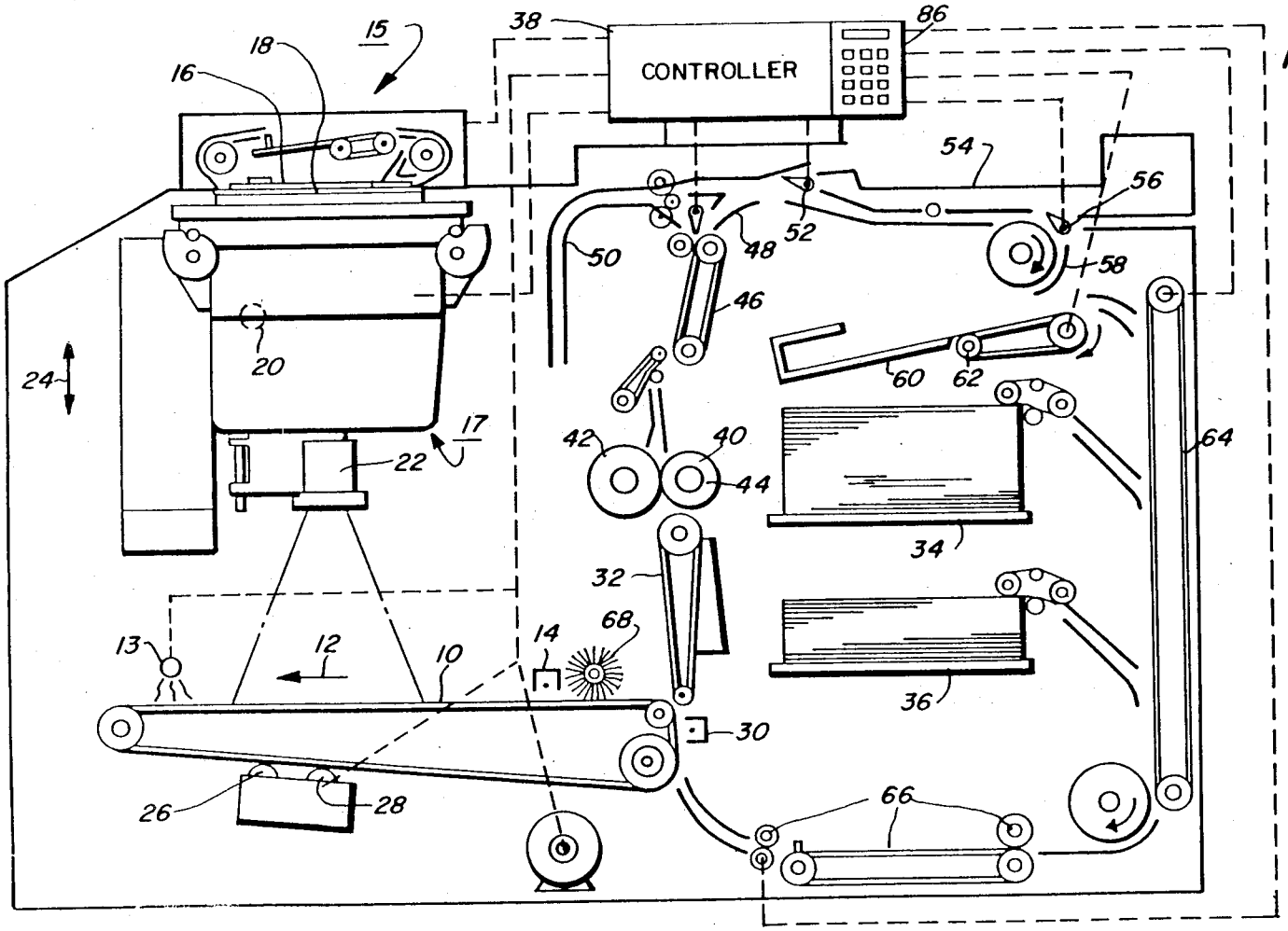
FIG. 1 is an elevational view of a reproduction machine that can be controlled in accordance with the present invention.

With reference to FIG. 1, there is shown an electrophotographic printing or reproduction machine employing a belt 10 having a photoconductive surface. Belt 10 moves in the direction of arrow 12 to advance successive portions of the photoconductive surface through various processing stations, starting with a charging station including a corona generating device 14. The corona generating device charges the photoconductive surface to a relatively high substantially uniform potential.

The charged portion of the photoconductive surface is then advanced through an imaging station. At the imaging station, a document handling unit 15 positions an original document 16 face down over exposure system 17. The exposure system 17 includes lamp 20 illuminating the document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge. This records an electrostatic latent image on the photoconductive surface corresponding to the informational areas contained within the original document. An erase lamp 13 electrically connected to controller 38 could be provided to selectively dissipate or erase portions of the document 16 that have been imaged on the photoconductive surface.

Platen 18 is mounted movably and arranged to move in the direction of arrows 24 to adjust the magnification of the original document being reproduced. Lens 22 moves in synchronism therewith so as to focus the light image of original document 16 onto the charged portion of the photoconductive surface of belt 10.

Document handling unit 15 sequentially feeds documents from a holding tray, in seriatim, to platen 18. The document handling unit recirculates documents back to the stack supported on the tray. Thereafter belt 10 advances the electrostatic latent image recorded on the photoconductive surface to a development station.

At the development station, a pair of magnetic brush developer rollers 26 and 28 advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to the transfer station. At the transfer station a copy sheet is moved into contact with the toner powder image. The transfer station includes a corona generating device 30 which sprays ions onto the backside of the copy sheet. This attracts the toner powder image from the photoconductive surface of belt 10 to the sheet.

The copy sheets are fed from a selected one of trays 34 or 36 to the transfer station. After transfer, conveyor 32 advances the sheet to a fusing station. The fusing station includes a fuser assembly for permanently affixing the transferred powder image to the copy sheet. Preferably, fuser assembly 40 includes a heated fuser roller 42 and back-up roller 44 with the sheet passing between fuser roller 42 and back-up roller 44 with the powder image contacting fuser roller 42.

After fusing, conveyor 46 transports the sheets to gate 48 which functions as an inverter selector. Depending upon the position of gate 48, the copy sheets will either be reflected into a sheet inverter 50 or bypass sheet inverter 50 and be fed directly onto a second gate 52. Decision gate 52 transport path which carries them on without inversion to a third output path of the copier, or deflects the sheets into a duplex inverter roll transport 58. Inverting transport 58 inverts and stacks the sheets to be duplexed in a duplex tray 60. Duplex tray 60 provides intermediate or buffer storage for those sheets which have been printed on one side for printing on the opposite side.

In order to complete duplex copying, the previously simplexed sheets in tray 60 are fed seriatim by bottom feeder 62 back to the transfer station for transfer of the toner powder image to the opposed side of the sheet. Conveyors 64 and 66 advance the sheet along a path which produces a sheet inversion. The duplex sheets are then fed through the same path as the previously simplexed sheets to be stacked in tray 54 for subsequent removal by the printing machine operator.

Invariably, after the copy sheet is separated from the photoconductive surface of belt 10, some residual particles remain adhering to belt 10. These residual particles are removed from the photoconductive surface thereof at a cleaning station. The cleaning station includes a rotatably mounted brush 68 in contact with the photoconductive surface of belt 10. The controller 38 and a control panel 86 are also illustrated in FIG. 1. The controller 38 as represented by dotted lines is electrically connected to various components of the printing machine, including erase lamp 13.

Figure 2:
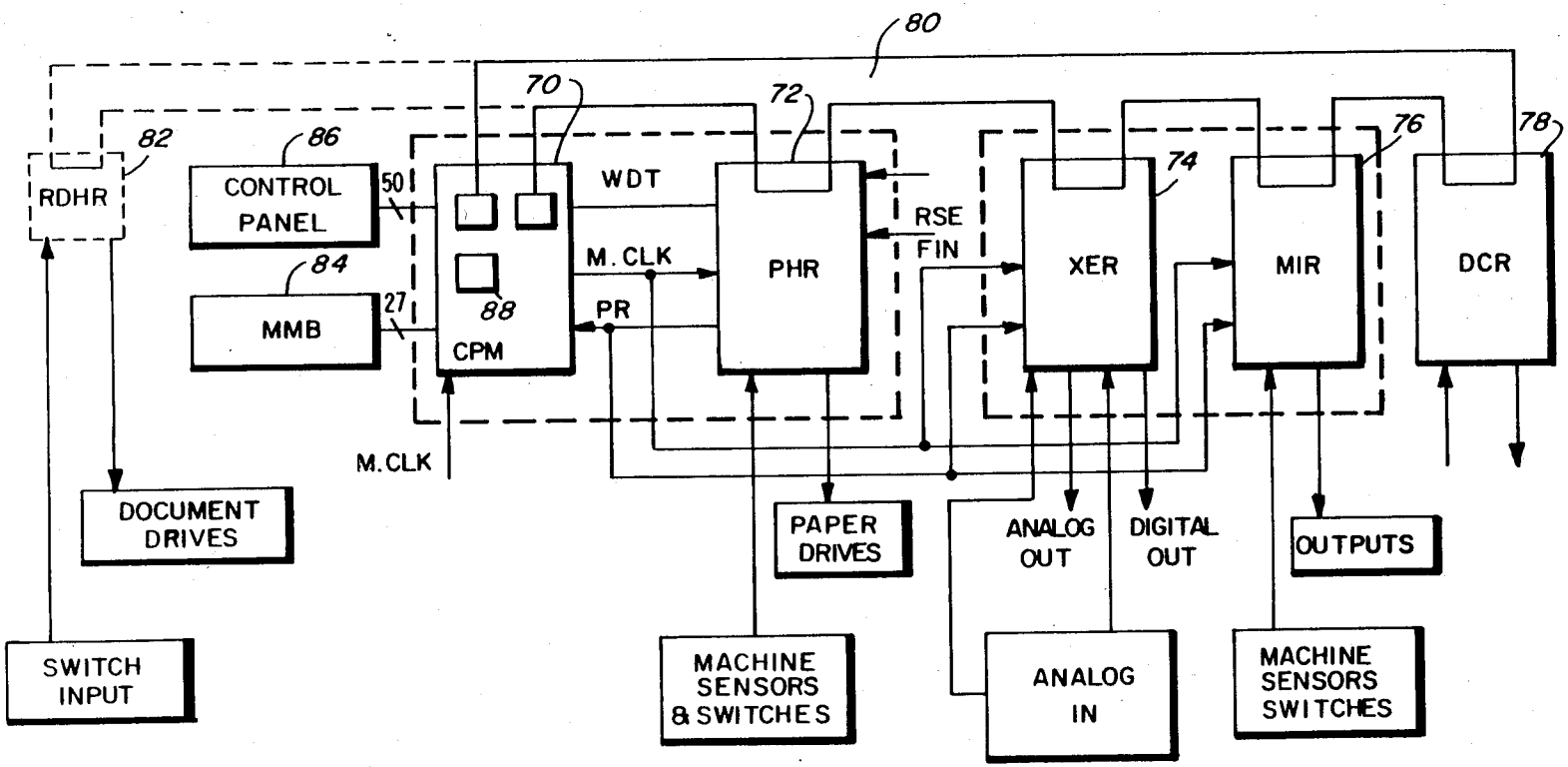
FIG. 2 is a block diagram of the control for the machine illustrated in FIG. 1.

With reference to FIG. 2, there is shown in further detail the controller 38 illustrated in FIG. 1. In particular, there is shown a Central Processing Master (CPM) control board 70 for communicating information to and from all other control boards, in particular, the Paper Handling Remote (PHR) control board 72, controlling the operation of the paper handling subsystem such as paper feed, registration and output transports.

Other control boards are the Xerographic Remote (XER) control board 74 for monitoring and controlling the xerographic process, in particular, the analog signals, the Marking and Imaging Remote (MIR) control board 76 for controlling the operation of the optics and xerographic subsystems, in particular the digital signals. A Display Control Remote (DCR) control board 78 is also connected to the CPM control board 70 providing operation and diagnostic information on both an alphanumeric and liquid crystal display. Interconnecting the control boards is a shared communication line 80, preferably a shielded coaxial cable or twisted pair with suitable communication protocol similar to that used in a Xerox Ethernet type$^R$ type communication system.

Other control boards can be interconnected to the shared communication line 80 as required. For example, a Recirculating Document Handling Remote (RDHR) control board 82 (shown in phantom) can be provided to control the operation of a recirculating document handler. There can also be provided a not shown Semi-Automatic Document Handler Remote (SADHR) control board to control the operation of a semi-automatic document handler, one or more not shown Sorter Output Remote (SOR) control boards to control the operation of one or more sorters, and a not shown Finisher Output Remote (FOR) control board to control the operation of a stacker stitcher.

Each of the controller boards preferably includes an Intel 8085 microprocessor with suitable Random Access Memory (RAM) and Read Only Memory (ROM).

Also, interconnected to the CPM control board is a Master Memory Board (MMB) 84 with suitable ROMs to control normal machine operation and a control panel board 86 for entering job selections and diagnostic programs. Also, contained in the CPM board 70 is suitable non-volatile memory. All of the control boards other than the CPM control board are generally referrerd to as remote control boards.

In a preferred embodiment, the control panel board 86 is directly connected to the CPM control board 70 and the memory board 84 is connected to the CPM control board 70 over a 36 line wire. Preferably, the Master Memory Board 84 contains 56K byte memory and the CPM control board 70 includes 2K ROM, 1K RAM, and a 512 byte non-volatile memory. The PHR control board 72 includes 1K RAM and 4K ROM and handles 29 inputs and 28 outputs. The XER control board 74 handles up to 24 analog inputs and provides 12 analog output signals and 8 digital output signals and includes 4K ROM and 1K RAM. The MIR board 76 handles 13 inputs and 17 outputs and has 4K ROM and 1K RAM.

As illustrated, the PHR, XER and MIR boards receive various switch and sensor information from the printing machine and provide various drive and activation signals, such as to clutches, motors and lamps in the operation of the printing machine. It should be understood that the control of various types of machines and processes are contemplated within the scope of this invention.

Figure 3:
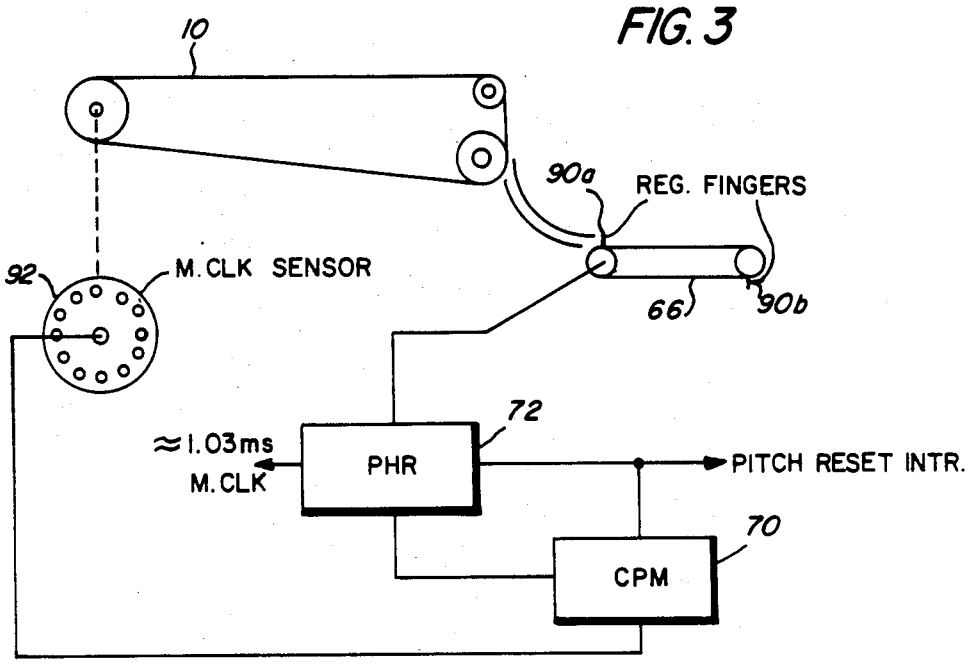
FIG. 3 illustrate some of the basic timing signals used in the control of the machine illustrated in FIG. 1.

A master timing signal, called the timing reset or Pitch Reset (PR) signal, as shown in FIG. 2, is generated by PHR board 72 and used by the CPM, PHR, MIR and XER control boards 70, 72, 74, and 76. With reference to FIG. 3, the Pitch Reset (PR) signal is generated in response to a sensed registration finger. Two registration fingers 90*a*, 90*b* on conveyor or registration transport 66 activate a not shown suitable sensor to produce the registration finger or pitch reset signal. The registration finger or pitch reset signal is conveyed to suitable control logic on the Paper Handler Remote control board 72. In addition, a Machine Clock signal (MCLK) is conveyed to the Paper Handling Remote 72 via the CPM remote board 70 to the same control logic.

In response to the MCLK signal, the timing reset pitch reset signal is conveyed to the CPM board 70 and the XER and the MIR remotes 74, 76. The machine clock signal is generated by a timing disk 92 or machine clock sensor connected to the main drive of the machine. The clock sensor signal allows the remote control boards to receive actual machine speed timing information.

The timing disk 92 rotation generates 1000 machine clock pulses every second. A registration finger sensed signal occurs once for every revolution of a registration finger as shown in FIG. 3. A belt hole pulse is also provided to synchronize the seam on the photoreceptor belt 10 with the transfer station to assure that images are not projected onto the seam of the photoreceptor belt.

Figure 4:
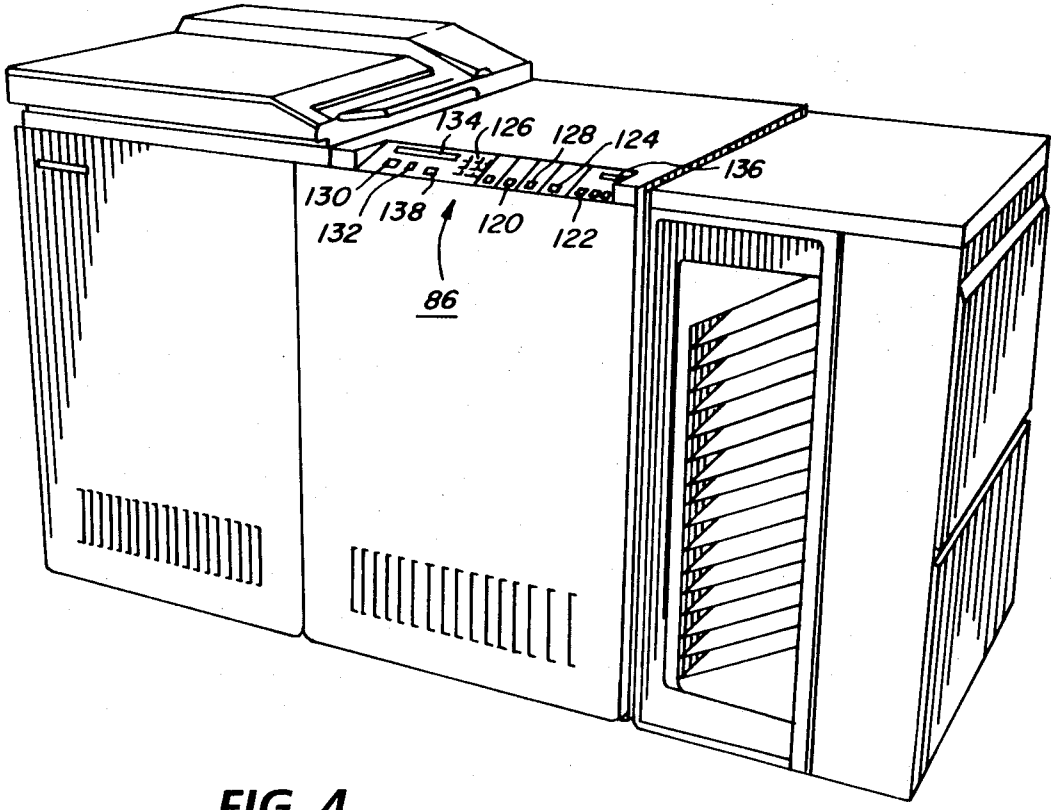
FIG. 4 PRIOR ART
FIG. 4 is an illustration of a typical control panel and display for a prior art control.

With reference to FIG. 4, a typical prior art control panel 86 is illustrated. It should be noted that it is relatively remote from the platen 18 and any tabs or markings that may be imprinted adjacent to the platen. The control panel 86 is electrically coupled to the CPM board. The control panel 86 allows an operator to select copy size (button 122), copy contrast (button 124), number of copies to be made (keys 126), and the simplex or duplex mode (button 128). Also, included on panel 86 are a start button 130, a stop button 132, an eight character 7 segment display 134, a three character 7 segment display 136, and a job interrupt button 138. The displays 134, provides the operator and Tech Rep with various operating and diagnostic information, and button 136 enables various magnification modes.

Figure 5:
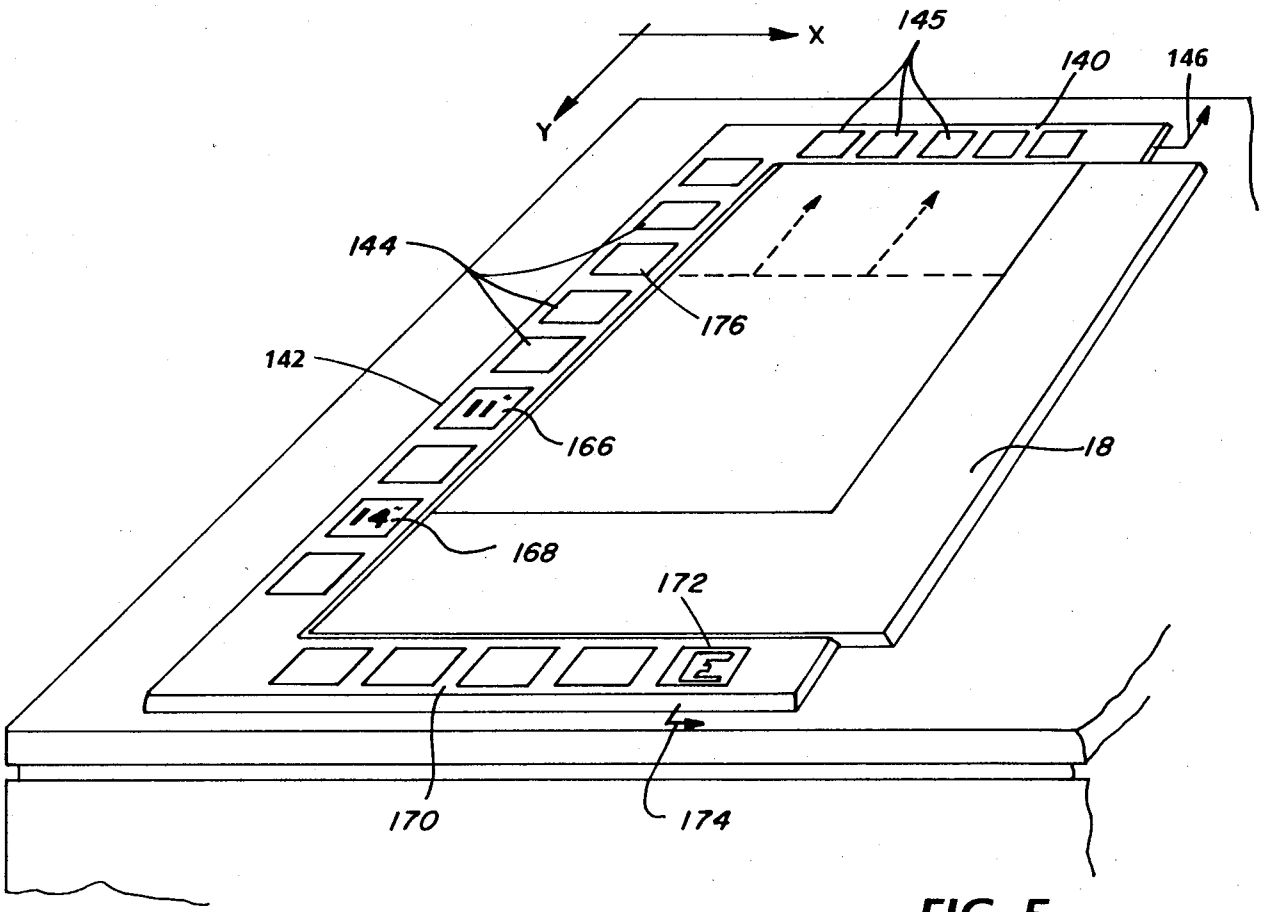
FIG. 5 is an illustration of a platen and membrane strip control in accordance with the present invention.

In accordance with the present invention, with reference to FIG. 5, there is illustrated a platen 18 flanked by a pair of electrically sensitive membrane strips 140 and 142. The membrane strip 140 is disposed along the top of the platen 18 in the direction of the x axis and the membrane strip 142 is disposed along the side of the platen 18 in the y axis direction. Each of the membrane strips includes a plurality of touch sensitive switch elements 144 in a side-by-side relationship extending from the origin of the membrane strip to the distal end. Each of the membrane strips is electrically connected by a suitable connection to the controller 38 as illustrated by the connector 146 with respect to the membrane strip 140.

Figure 6:
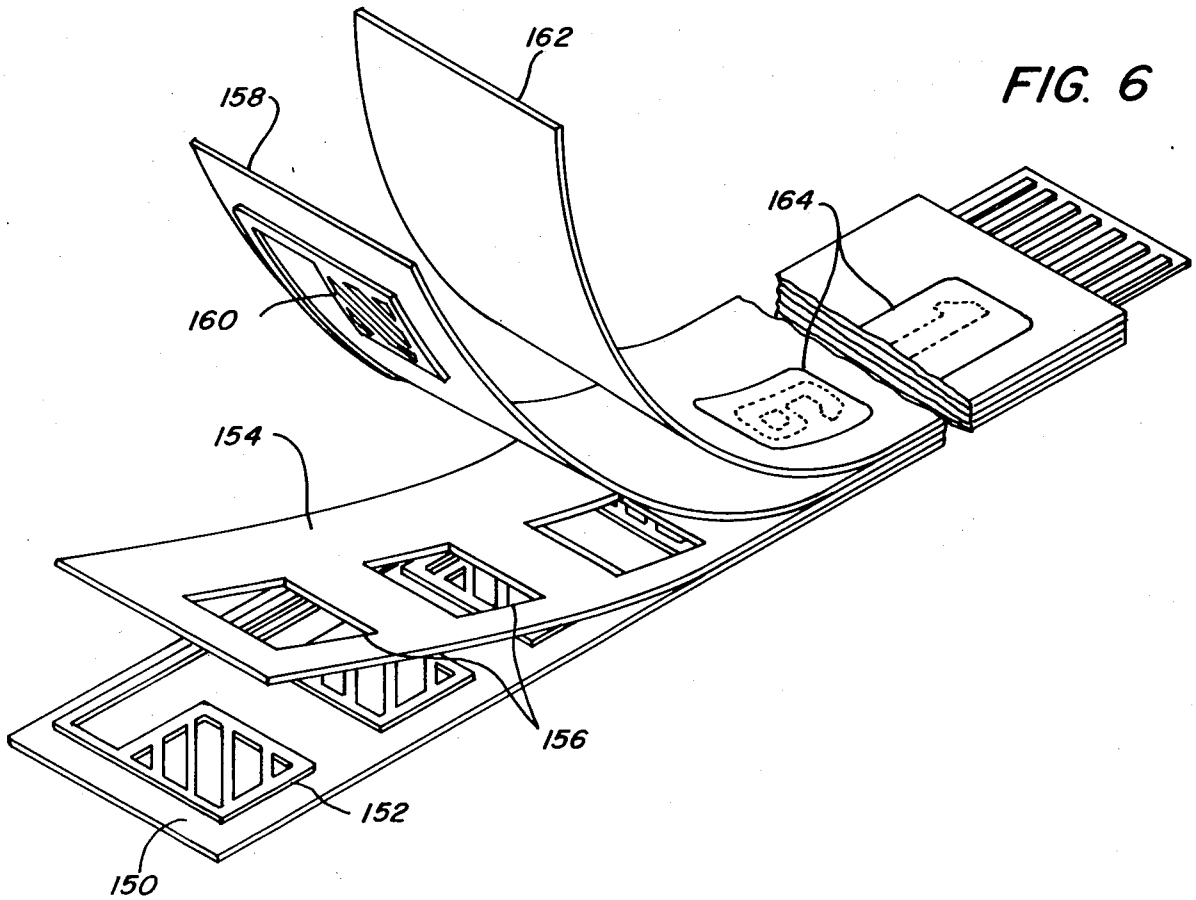
FIG. 6 is an illustration of the construction of an electrically sensitive membrane strip.

The construction of a typical electrically sensitive membrane strip is shown in FIG. 6. Typically, there is a bottom layer 150 of a flexible plastic or other suitable material having deposited thereon an appropriate electrical pattern such as the touch pad illustrated at 152. The electrical patterns can be silver or any other suitable conductive material deposited on the backing 150 by deposition or in any other suitable manner. The pattern 152 forms a first part of an electrical circuit or connection. A second layer of 154 of flexible plastic or any other suitable material is laid on top of the first 150. The second layer 154 is a spacer element and includes an opening 156 disposed in an overlying relationship with the electrical pattern 152. On top of the spacer 154 is a third layer 150 of flexible plastic with a electrical pattern 160 of silver or any other suitable conductive meterial suitably thereon.

The electrical pattern 160 forms the second half of the electrical circuit with the electrical pattern 152. With the three layers, 150, 154 and 158 aligned and suitably secured together, the electrical pattern 160 is disposed opposite the electrical pattern 152 separated only by the spacer 154. This arrangement provides an electrical switch, the electrical pattern 160 also being suitably connected to the controller 86. It should be noted that various shapes and configurations of electrical patterns to provide switching elements are contemplated within the scope of the present application.

Completing the electrically sensitive membrane strip is a top or graphics layer 162 suitably secured to the third layer 158. The graphics layer includes any suitable indication of the electrical pattern underneath the first and third layers, such as a simple square or round indicator 164 directly above the pattern 160. Any symbols or icons can be used in the graphics cover layer as a prompt to an operator to select the appropriate electrical connection or switch. with regard to the membrane strips 140 and 142, the graphics could be any key indicator to prompt the operator to touch or engage the membrane strip at a particular location. As illustrated in FIG. 5, each of the membrane strips is series or sequence of electrical patterns forming buttons or switches.

In operation, to activate a switch, by touching the appropriate button or switch indicator on the graphics layer 160, such as the indicator 164, the pressure of the operator's finger on the indicator 162 presses the graphics 162 layer against the third layer 158. The pressure on the electrical pattern 160 forces the electrical pattern 160 through the opening 156 and the spacer 154 into contact with the electrical pattern 152 on the first layer 150. This closes the electrical connection and provides an appropriate signal to the controller 38 that the electrical contact was made at that particular location or position on the membrane strip. For example, with reference to FIG. 5, if the operator pressure contact is made at the button 166, suitable logic in the control would recognize that the connection was made at the particular position identified on the platen as an 11" document. Similarly, if the operator engages the key or switch 168, an indication would be provided that the length of the document is 14". Thus, it is only necessary for an operator to press the switch indicator in both the x and y direction along the membrane elements 140 and 142 to provide suitable signals to the controller 38, identifying the document size. The numbers 11 and 14 are shown for illustration purposes and could be omitted, since it is only necessary for the operator to register the document and activate the appropriate switch elements to convey to the controller the exact document size. This eliminates the possibility of confusion and error on the part of the operator in entering the correct document size.

It should be noted that the membrane switch can be an electrical switch with closure completing the circuit as described. In the alternative, a resistance bar could be applied to a Mylar strip with a solid conductor on the upper layer. Making contact at different points provides variable resistance readings that can be translated by the controller into document size length and width measurements. It should be noted, also, that preferably, every time an operator closes an electric circuit on the membrane, a switch feedback is provided such as a display flash or change or an auditory response such as a beep. This satisfies the operator that a particular selection has been completed.

It should be noted that electrically sensitive membranes could also be provided at the document input tray for an operator to provide information on the size of the documents immediately as documents are placed at the input tray. Membrane strips could also be placed at the copy sheet trays to enter information on the size of the copy sheets that are in the copy sheet tray. Various options would thus be available as to magnification and reduction. The control, immediately sensing the document and copy sheet sizes, using routine comparison logic, could determine the appropriate magnification or reduction size commensurate with the size of the input documents and the copy sheets available.

In accordance with another aspect of the present invention, a third electrically sensitive membrane 170 is illustrated disposed along the bottom edge of the platen 18. The third electrically sensitive membrane strip 170 could provide various operator functions conveniently to the operator when doing manual copying. For example, the strip could contain the switches to select number of copies, to start the operation, to select a suitable magnification ratio, or to select any other of the process parameters such as copy light and copy dark needed for the particular job requirement. The construction of the third membrane strip would be similar to the construction of the membrane strips 140 and 142, with the only significant difference in the overlay or cover layer strip having suitable icons, identifiers or printed information to aid the operator in the selection of the appropriate switch. However, as in the membrane strips 140 and 142, the two opposed switch sections would be provided with the pressure of the operator's engagement of the suitable icon or identifier pressing the two electrical connectors or pads into engagement to complete the circuit thus providing a suitable control signal to the controller 38.

In accordance with another aspect of the present invention, one of the switch buttons or keys on the third membrane strip 170 is an edit function. Activation of the edit key 172 provides an edit signal over a suitable electrical connector illustrated at 174 to the controller 38. The edit signal conditions the controller 38 to respond to the switch signals from the membranes 140 and 142 to activate the erase lamp 13. Such control features are implemented with routine software in the control or with routine logic circuits. Thus, the operator selectively edits or selectively projects only certain portions of the document on the platen 18 to be copied or reproduced. The operator may desire to erase the heading from the document on the platen 18. As an example, the operator would depress the edit button 172 and the button 176 on the membrane strip 142. In response, the controller 38 selectively activates the lamp 15 after projection of the document information onto the photoreceptor surface to erase the information from the top of the document to the location 176 in the y direction as illustrated by the dotted line and arrows in FIG. 5.

Many variations of the editing feature as described are within the scope of the present invention. It can be appreciated that blocks of information can be selected for erasure or editing by the use of a dedicated editing switch 172 and appropriate selection of the membrane switches in the x and y direction along the document. The number and density of the switch elements that are constructed into each of the membranes in the x and y direction can determine the degree of resolution for preciseness of the editing functions. Other alternatives, such as selecting only those areas to be copied could be used rather than selecting those areas to be deleted. Typical control logic is illustrated, for example, in U.S. Pat. Nos. 3,689,143 and 4,227,163. It is also understood, that a membrane strip with a suitable graphics or cover layer could overly and entire image or viewing area to be used as an electronic composing station. A total image area would be electronically and topographically sensitive to user touch to provide appropriate control information.

While the instant invention as to its objects and advantage have been described as carried out in a specific embodiment, it is not intended to be limited thereby but to be covered broadly within the scope of the appended claims.

What is claimed is:

1. In a copier having a controller and a platen upon which an original is placed for exposure, a control system for entering dimensional data into the controller, the control system comprising:

a first electrically sensitive membrane strip disposed along one axis of the platen, a second electrically sensitive membrane strip disposed along another axis of the platen, the membrane strips being conterminous with the edges of the platen, said membrane strips being formed with touch sensitive portions such that touching by an operator effects a signal indicative of the location of the touch contact, means connecting said strips to the controller for transmitting said signals thereto as indicative of the dimension of the original along the effected edge thereof, and a third electrically sensitive membrane strip, said third electrically sensitive membrane strip electrically connected to the controller and including a conversion switch, activation of said conversion switch enabling the touching of said touch sensitive portions to selectively edit segments of the document related thereto.

2. The control system of claim 1 wherein the third membrane strip cotorminous with one edge of the platen.

3. The control system of claim 1 including a plurality of switches for operating upon said original to produce a predetermined copy of said original, said plurality of switches being disposed on the third membrane strip.

4. In a copier having a controller and a platen upon which an original is placed for exposure, a control system for entering data into the controller, the control system comprising:

an electrically sensitive membrane strip disposed near the platen and electrically connected to the controller, said membrane strip being formed with a touch sensitive portion such that touching by an operator effects a first control signal indicative of the touch contact, a conversion switch electrically connected to the controller, activation of said conversion switch enabling the touching of said touch sensitive portion of the electrically sensitive membrane strip to selectively effect a second control signal indicative of the touch control, the second control signal being different than the first control signal and means connecting said membrane strip and the switch to the controller for transmitting said signals thereto.

5. In a copier having a controller and a platen upon which an original is placed for exposure, a control system for entering dimensional data into the controller, the control system comprising:

a first electrically sensitive membrane strip disposed along one axis of the platen, a second electrically sensitive membrane strip disposed along another axis of the platen, the membrane strips being coterminous with the edges of the platen, said membrane strips being formed with touch sensitive portions such that touching by an opertor effects a signal indicative of the location of the touch contract, means connecting said strips to the controller for transmitting said signals thereto as indicative of the dimension of the original along the effected edge thereof, and a third electrically sensitive membrane strip, said third electrically sensitive membrane strip electrically connected to the controller and including a conversion switch, activation of said conversion switch enabling the touching of said touch sensitive portions to selectively edit segments of the document related thereto.

* * * * *